US006412265B1

(12) United States Patent
Yamamoto et al.

(10) Patent No.: US 6,412,265 B1
(45) Date of Patent: Jul. 2, 2002

(54) TWISTED FLAT CABLE

(75) Inventors: Tetsuhiro Yamamoto; Satoshi Mizushima, both of Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/948,126

(22) Filed: Sep. 7, 2001

(30) Foreign Application Priority Data

Apr. 2, 2001 (JP) ..... 2001-103476

(51) Int. Cl.[7] ..... H01B 7/08
(52) U.S. Cl. ..... 57/242; 57/231; 57/234
(58) Field of Search ..... 57/214, 215, 217, 57/219, 221, 232, 233, 234, 241, 242, 237; 174/117 F, 117 A, 117 R, 129 R; 156/47, 50

(56) References Cited

U.S. PATENT DOCUMENTS 587,764 A * 8/1897 Short ..... 174/129 R
1,209,096 A * 12/1916 Williamson ..... 156/55
3,695,027 A * 10/1972 Copp ..... 57/233
4,439,256 A * 3/1984 Meserve ..... 156/50
4,455,818 A * 6/1984 Sugimoto et al. ..... 174/117 F
4,529,837 A * 7/1985 Borden ..... 156/50
4,947,637 A * 8/1990 Royet et al. ..... 57/13
6,270,598 B1 * 8/2001 Kasahara et al. ..... 140/149

* cited by examiner

*Primary Examiner*—Danny Worrell
(74) *Attorney, Agent, or Firm*—Antonelli, Terry, Stout & Kraus, LLP

(57) ABSTRACT

A plurality of perforations 6 has been defined on a plastic tape 5 to be laminated on insulated wire cores 2. Accordingly, intrusions of the plastic tape 5 in between each of pair-twisted sections 4 are elevated in laminating step of the plastic tape 5. As a result, collapses in the pair-twisted sections 4 decrease, and in addition, portions of a tape material corresponding to perforations 6 defined on the plastic tape 5 are replaced by air, so that dielectric constant between conductors of the insulated wire cores 2 decreases, whereby decrease in impedance can be reduced. Thus, a twisted flat cable I exhibiting flexibility and accompanying with no decrease in impedance in laminating step is provided.

1 Claim, 3 Drawing Sheets

TWISTED FLAT CABLE

BACKGROUND OF THE INVENTION

1. Field of the Invention

The present invention relates to a twisted flat cable used for internal wiring of electronic equipment such as computers.

2. Prior Art

A flat cable used for internal wiring of electronic equipment such as computers is prepared in such that conductors are arranged in parallel to each other, and they are insulated in accordance with a trend of downsizing as well as weight reduction for electronic equipment for the purpose of cut-back for wiring such as space-saving wiring or of cut-back for mounting a flat cable, and maintenance and inspecting operations therefor.

Merits of such flat cable as mentioned above are enumerated in the following items (1) to (6).

(1) It is possible to omit bundling insulated wire cores.

(2) It is possible to elevate a packaging density of electronic parts or the like.

(3) There is little fear of erroneous wiring, besides maintenance and inspection are also easy.

(4) There is sufficient flexibility so that wiring is easy.

(5) It is possible to reduce the number of steps for terminal processing.

(6) It is easy to correspond to automation for cutting a cable or mounting a connector.

In FIGS. 1, 2 and 3, a twisted flat cable being a type of flat cables are shown, respectively, wherein FIG. 1 is a plan view showing a conventional twisted flat cable; FIG. 2 is a sectional view taken along the line A—A of the twisted flat cable shown in FIG. 1; and FIG. 3 is a plan view showing a plastic tape used in the twisted flat cable shown in FIG. 1.

A twisted flat cable 51 shown in FIG. 1 is composed of a plurality of insulated wire cores 52 arranged in parallel to each other wherein molten sections 53 each prepared by melting all the adjacent insulated wire cores 52 with each other are alternately disposed in the longitudinal direction thereof with a predetermined interval with respect to pair-twisted sections 54 each prepared by pair-twisting each adjacent pairs of insulated wire cores among adjacent insulated wire cores 52 with each other.

A plastic tape 55 is welded (laminated) on either surface (the under surface in FIG. 2) of the arranged insulated wire cores 52 over the whole length thereof. An adhesive layer has been prepared on either surface of the plastic tape 55 (the upper surface in FIG. 2). Lamination is made after bonding the insulated wire cores 52 to the adhesive layer.

In the above-mentioned twisted flat cable 51, however, since the plastic tape 55 has been disposed over the whole length of the twisted flat cable, the plastic tape 55 does not enter flexibly into a gap defined in between pair-twisted sections 54, so that there is such a tendency that the pair-twisted sections 54 are collapsed in a laminating step. Furthermore, since the plastic tape 55 has been applied to the whole surface of the twisted flat cable 51, there has been such a tendency that dielectric constant thereof becomes higher between insulated wire cores than that of a product without lamination processing.

Thus, there has been such a problem that impedance decreases in a pair each of the molten sections and the pair-twisted sections 54.

SUMMARY OF THE INVENTION

Accordingly, an object of the present invention is to solve the above-described problems, and to provide a twisted flat cable, which exhibits flexibility and accompanies with no decrease of impedance in laminating step.

In order to achieve the above-described object, a twisted flat cable of the present invention composed of a plurality of insulated wire cores arranged in parallel to each other wherein molten sections each prepared by melting all the adjacent insulated wire cores with each other are alternately disposed in the longitudinal direction thereof with respect to pair-twisted sections each prepared by pair-twisting each adjacent pairs of insulated wire cores among adjacent insulated wire cores with each other, comprises a plastic tape having an adhesive layer on either surface thereof as well as having a plurality of perforations defined thereon being laminated on the insulated wire cores arranged in parallel to each other so as to be in contact with the adhesive layer.

According to the present invention, a plurality of perforations has been defined on a plastic tape to be laminated on insulated wire cores. Accordingly, intrusions of the plastic tape in between each of pair-twisted sections are elevated in laminating step of the plastic tape. As a result, collapses in pair-twisted sections decrease, and in addition, portions of a tape material corresponding to perforations defined on the plastic tape are replaced by air, so that dielectric constant between conductors of the insulated wire cores decreases, whereby decrease in impedance can be reduced.

BRIEF DESCRIPTION OF THE DRAWINGS

The present invention will be explained in more detail in conjunction with appended drawings, wherein.

DESCRIPTION OF THE PREFERRED EMBODIMENTS

Figure 1:
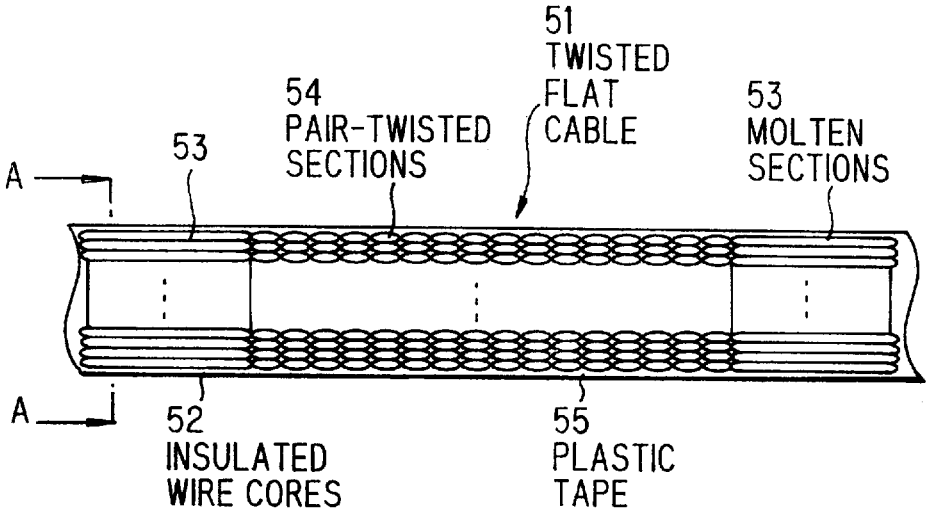
FIG. 1 PRIOR ART
FIG. 1 is a plan view showing a conventional twisted flat cable.
Figure 2:
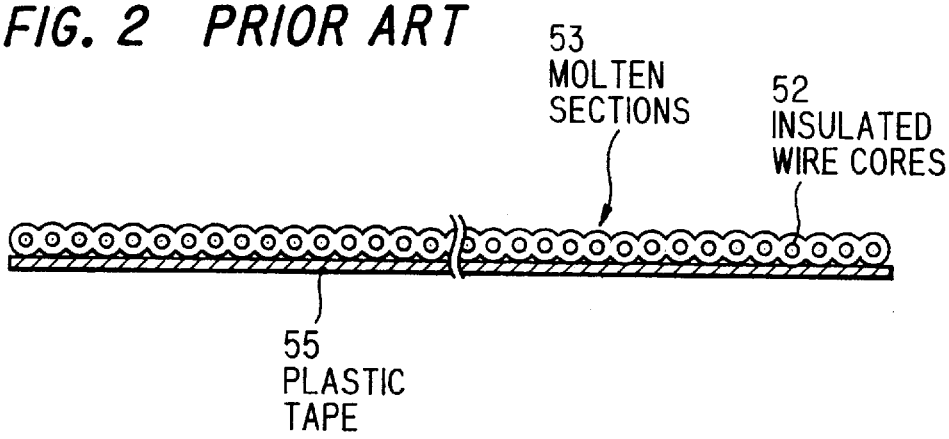
FIG. 2 PRIOR ART
FIG. 2 is a sectional view taken along the line A—A of the twisted flat cable shown in FIG. 1.
Figure 3:
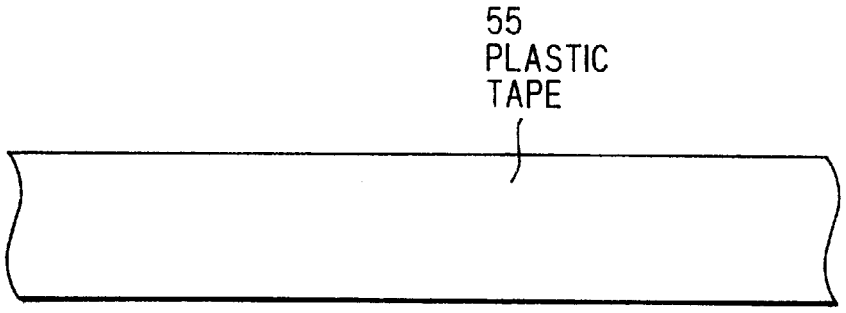
FIG. 3 PRIOR ART
FIG. 3 is a plan view showing a plastic tape used for the twisted flat cable shown in FIG. 1.
Figure 4:
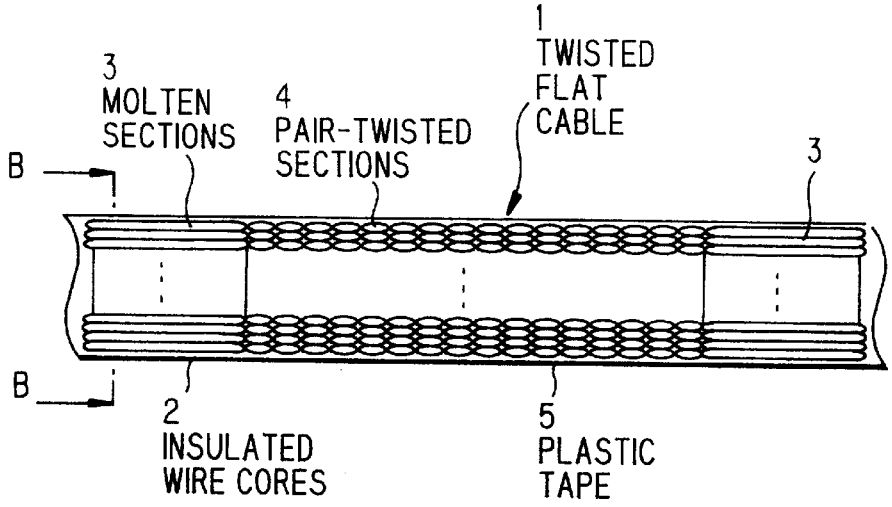
FIG. 4 is a plan view showing an embodiment of a twisted flat cable according to the present invention.
Figure 5:
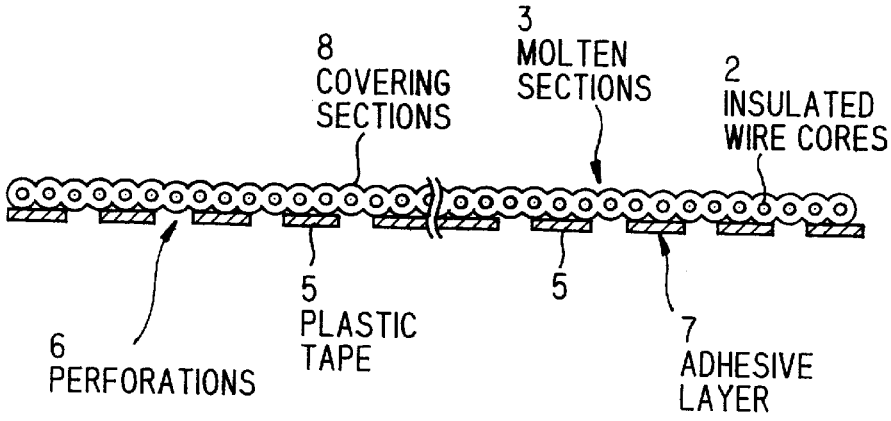
FIG. 5 is a sectional view taken along the line B—B of the twisted flat cable shown in FIG. 4.
Figure 6:
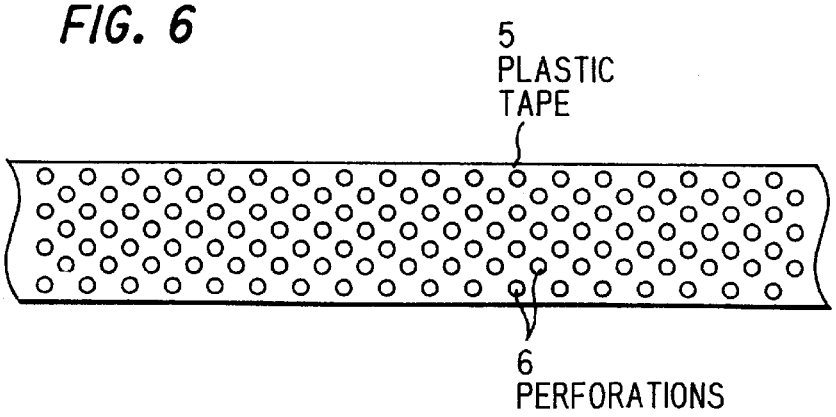
FIG. 6 is a plan view showing a plastic tape used for the twisted flat cable shown in FIG. 4.

In the following, an embodiment of the present invention will be described in detail by referring to the accompanying drawings wherein FIG. 4 is a plan view showing an embodiment of a twisted flat cable according to the present invention, FIG. 5 is a sectional view taken along the line B—B of the twisted flat cable shown in FIG. 4, and FIG. 6 is a plan view showing a plastic tape used for the twisted flat cable shown in FIG. 4.

A twisted flat cable 1 of the present embodiment is the one composed of a plurality of insulated wire cores arranged in parallel to each other wherein molten sections 3 each prepared by melting all the adjacent insulated wire cores 2 with each other are alternately disposed in the longitudinal direction thereof with respect to pair-twisted sections 4 each prepared by pair-twisting each adjacent pairs of insulated wire cores among adjacent insulated wire cores 2 with each other. A plastic tape 5 having an adhesive layer 7 on either surface (the upper surface in FIG. 5) thereof as well as having a plurality of perforations 6 defined with a predetermined interval is laminated on the plurality of insulated wire cores 2 arranged in parallel to each other so as to be in contact with the adhesive layer 7.

In the molten sections 3, covering sections 8 of the insulated wire cores 2 are heated with each other to be fusion-bonded, whereby they are integrated with each other, while gaps are defined in between adjacent insulated wire cores 2 in the pair-twisted sections 4.

Namely, the molten sections 3 and the pair-twisted sections 4 are alternately formed with a predetermined length along the longitudinal direction of the twisted flat cable.

The perforations 6 are defined in such that the plastic tape intrudes flexibly into each spacing defined between the pair-twisted sections 4 in laminating step wherein the plastic tape 5 is fusion-bonded to insulated wire cores, whereby a dielectric constant in between the insulated wire cores 2 is reduced as much as possible. In this respect, a distance defined between adjacent perforations 6 is not specifically restricted. However, each of perforations 6 positioned in the pair-twisted sections 4 is preferred to have a small inside diameter, and many numbers of perforations are preferred. For instance, an inside diameter of each of the perforations 6 is four to eight mm, and preferably about 6 mm. Each pitch of the perforations 6 is preferred to be the inside diameter+ about two mm.

Although the present embodiment has been described with respect to a case where a profile of each of the perforations is a circle, the present invention is not limited thereto, but it may be, for example, an ellipse or a polygon.

Furthermore, positions for the perforations are not necessary for assuring to keep a predetermined distance, but they may be defined randomly so far as the perforations are defined on each of parts corresponding to the pair-twisted sections.

In the following, operations of the present twisted flat cable will be described.

Since perforations 6 have been defined on a plastic tape 5 in the present twisted flat cable 1, flexibility can be brought out in the plastic tape 5 in laminating step, so that a dielectric constant of insulated wire cores 2 can be reduced.

Thus, decrease in impedance of the twisted flat cable 1 occurred in laminating step of the plastic tape 5 with respect to the insulated wire cores 2 can be reduced.

Moreover, a weight of the plastic tape 5 decreases in an amount corresponding to that excluded from the plastic tape 5 as the perforations 6, and as a result, weight reduction in the twisted flat cable 1 can be attained.

Besides, a plurality of the perforations 6 have been defined on the plastic tape 5, whereby flexibility thereof is improved, so that mounting operability for the twisted flat cable 1 is elevated.

Figure 7:
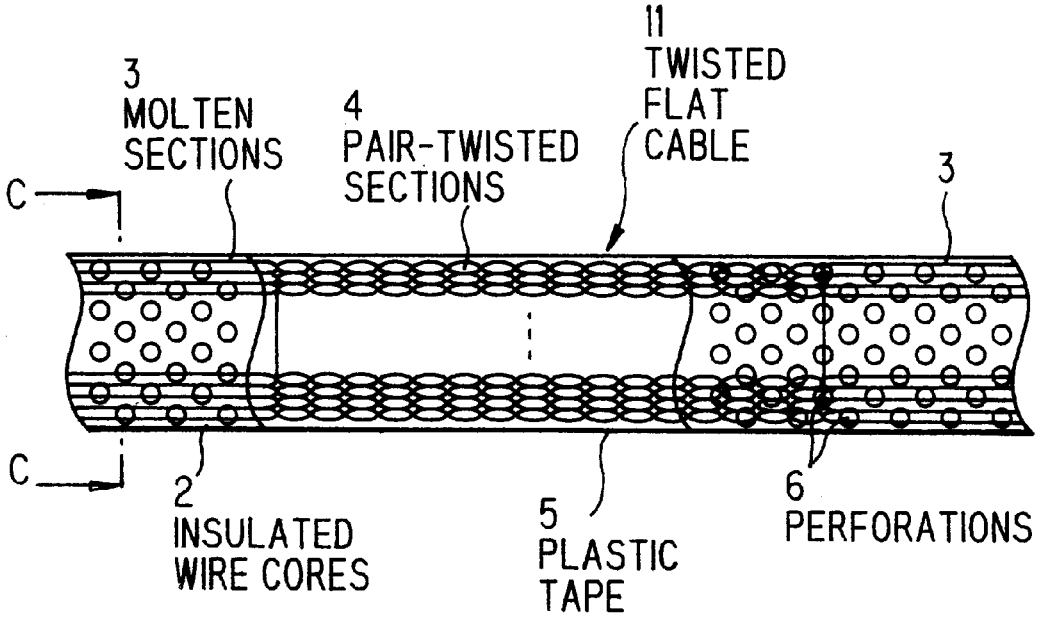
FIG. 7 is a plan view showing another embodiment of a twisted flat cable according to the present invention.
Figure 8:
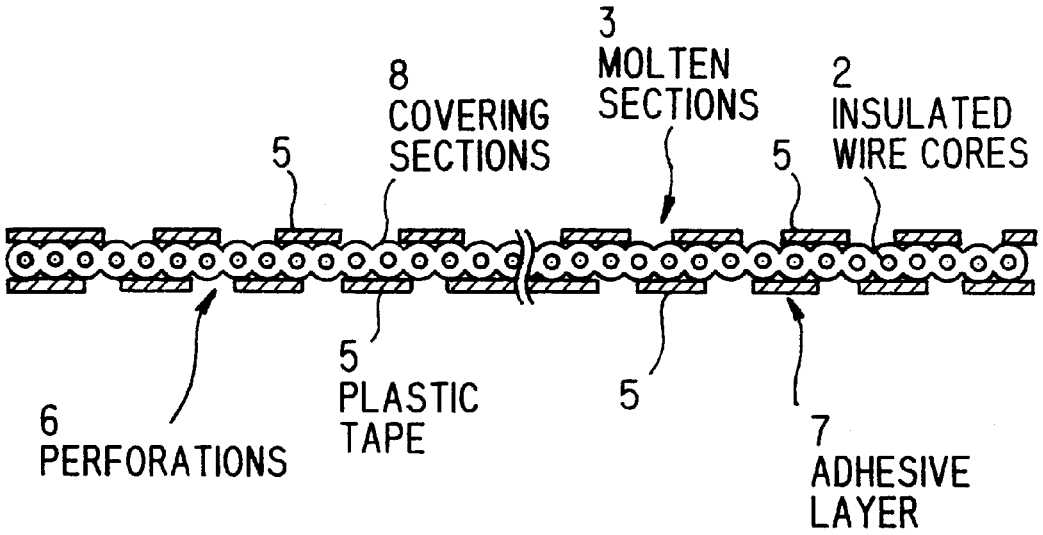
FIG. 8 is a sectional view taken along the line C—C of the twisted flat cable shown in FIG. 7.

FIG. 7 is a plan view showing another embodiment of a twisted flat cable according to the present invention, and FIG. 8 is a sectional view taken along the line C—C of the twisted flat cable shown in FIG. 7.

The twisted flat cable 11 shown in FIG. 8 differs from the twisted flat cable 1 shown in FIG. 4 in that plastic tapes are laminated on both the surfaces (the upper and lower surfaces in FIG. 8) of arranged plural insulated wire cores 2 wherein a plurality of perforations have been defined on each of the plastic tapes as in the twisted flat cable shown in FIG. 4.

The twisted flat cable 11 can improve impedance as in the case of the twisted flat cable shown in FIG. 4. In addition, since two plastic tapes 5 have been used, the both surfaces of the insulated wire cores 2 are protected, whereby durability of the twisted flat cable 11 is elevated.

A plastic tape to be used for the present twisted flat cable is not limited to those used only for twisted flat cable, but any plastic tape used for other types of flat cable is applicable. Moreover, it is to be noted that although a case where positions of perforations had been staggered have been shown with respect to the twisted flat cable shown in FIGS. 7 and 8, the present invention is not limited thereto, but the perforations may be defined at each of corresponding positions in both the plastic films.

According to the present invention, as described above, since perforations have been defined on a plastic tape, the tape can exhibit flexibility in tape-laminating step. Furthermore, since a dielectric constant of insulated wire cores can be reduced, decrease in impedance can be reduced in such tape-laminating step.

In brief, the present invention provides the following excellent advantages.

Namely, a twisted flat cable involving no decrease in impedance in laminating step can be attained.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A twisted flat cable composed of a plurality of insulated wire cores arranged in parallel to each other wherein molten sections each prepared by melting all the adjacent insulated wire cores with each other are alternately disposed in the longitudinal direction thereof with respect to pair-twisted sections each prepared by pair-twisting each adjacent pairs of insulated wire cores among adjacent insulated wire cores with each other, comprising:

a plastic tape having an adhesive layer on either surface thereof as well as having a plurality of perforations defined thereon being laminated on said insulated wire cores arranged in parallel to each other so as to be in contact with said adhesive layer.

* * * * *